US006720927B2

(12) United States Patent
Bakker et al.

(10) Patent No.: US 6,720,927 B2
(45) Date of Patent: Apr. 13, 2004

(54) SYSTEM FOR DEPLOYING AN ANTENNA OF AN INTEGRATED CIRCUIT CARD

(75) Inventors: Jan Bakker, Doorn (NL); John Leslie Blair, Atlanta, GA (US); Nedim Erkocevic, Delfgauw (NL); Frans Hoekstra, Elst Ut (NL); Han Schmitz, Utrecht (NL); Damon E. Stauffer, Cumming, GA (US); Raymond R. Thomas, Atlanta, GA (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 10/042,510

(22) Filed: Jan. 9, 2002

(65) Prior Publication Data

US 2003/0128166 A1 Jul. 10, 2003

(51) Int. Cl.[7] ..... H01Q 1/24
(52) U.S. Cl. ..... 343/702; 343/872
(58) Field of Search ..... 343/702, 872, 343/803, 806; 455/89, 90; 235/435, 439, 492

(56) References Cited

U.S. PATENT DOCUMENTS

| | | | | | |
|---|---|---|---|---|---|
| 5,657,028 | A | * | 8/1997 | Sanad | 343/700 MS |
| 5,918,163 | A | * | 6/1999 | Rossi | 455/558 |
| 5,943,018 | A | * | 8/1999 | Miller | 343/702 |
| 6,292,148 | B1 | * | 9/2001 | Matsuura et al. | 343/702 |
| 6,359,591 | B1 | * | 3/2002 | Mou | 343/702 |
| 6,437,745 | B1 | * | 8/2002 | Vaisanen et al. | 343/702 |
| 6,456,245 | B1 | * | 9/2002 | Crawford | 343/702 |
| 6,509,876 | B1 | * | 1/2003 | Jones et al. | 343/702 |
| 6,518,927 | B2 | * | 2/2003 | Schremmer et al. | 343/702 |

* cited by examiner

*Primary Examiner*—Tan Ho
(74) *Attorney, Agent, or Firm*—Harness, Dickey & Pierce, P.L.C.

(57) ABSTRACT

The system for deploying an antenna of an integrated circuit card includes a card housing protecting electronic components, and at least one antenna. The antenna has a proximal end and a distal end, and an antenna housing protects the antenna. The antenna housing is movably connected to the card housing such that as the antenna housing moves relative to the card housing, the distal end of the antenna moves relative to the card housing.

20 Claims, 4 Drawing Sheets

SYSTEM FOR DEPLOYING AN ANTENNA OF AN INTEGRATED CIRCUIT CARD

BACKGROUND OF THE INVENTION

1. Field of the Invention

The present invention relates to integrated circuit cards, for example, integrated circuit cards meeting the Personal Computer Memory Card International Association (PCMCIA) specifications; and more particularly, a system for deploying an antenna of an integrated circuit card.

2. Description of Related Art

Integrated circuit card standards such as PCMCIA were established to facilitate uniformity among vendors. PCMCIA for example established specifications for use of credit card sized electronic cards to interface with computers. However, many providers of wireless network interface cards for computers have resorted to using a non-standard PCMCIA card. A standard PCMCIA card is substantially housed within a computer, for example, a laptop computer, when inserted. As a result the radiation characteristics of an antenna or antennas forming a part of a wireless network interface card meeting PCMCIA standards are quite poor.

By resorting to a non-standard PCMCIA card, the antenna or antennas of the wireless network interface card can be positioned outside of the computer to improve radiation characteristics. Because the non-standard PCMCIA card extends out beyond the PCMCIA compartment of the computer, the card is not protected and subject to possible damage. Further, problems arise in transporting the computer. To fit within a carrying case or shipping container, the PCMCIA card often has to be removed, which is seen as a disadvantage by computer users and manufacturers.

SUMMARY OF THE INVENTION

The present invention provides an integrated circuit card that includes a system for deploying an antenna. An antenna housing is provided movably connected to the card housing. The antenna housing protects the antenna, and by moving the antenna housing relative to the card housing, a distal end of the antenna is extended or retracted relative to the card housing.

Through this design, the integrated circuit card meets standards when the antenna housing is in the retracted state, but provides for beneficial radiation characteristics in the extended state. As such, removing and replacing the integrated circuit card to transport a computer is not required, and when not in use, the integrated circuit card is protected from damage.

BRIEF DESCRIPTION OF THE DRAWINGS

The present invention will become more fully understood from the detailed description given herein below and the accompanying drawings which are given by way of illustration only, wherein like reference numerals designate corresponding parts in the various drawings, and wherein.

DETAILED DESCRIPTION OF THE PREFERRED EMBODIMENTS

Figure 5A:
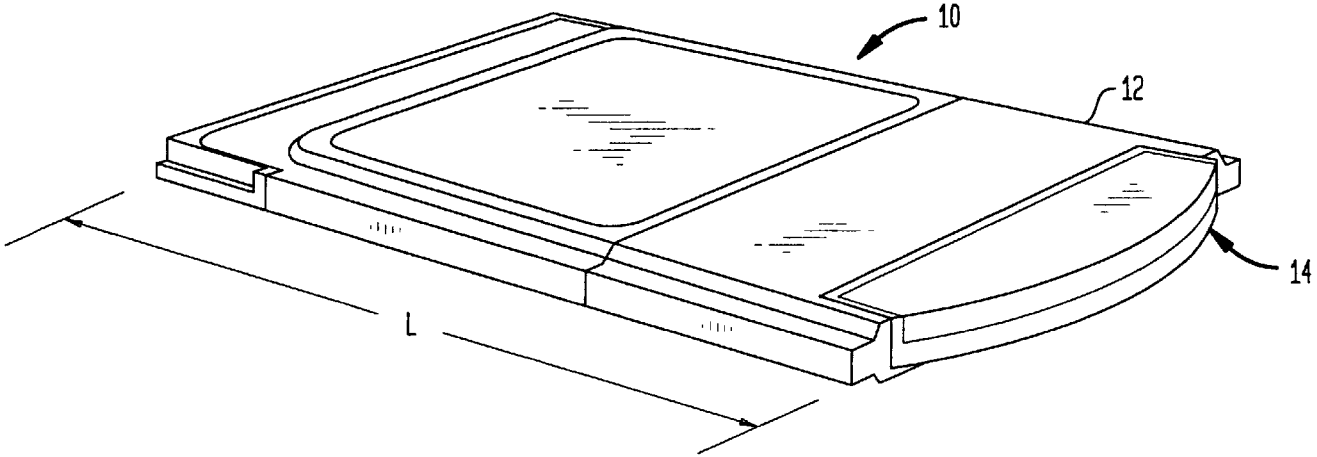
FIGS. 5A and 5B illustrate a perspective view an integrated circuit card according to the present invention.
Figure 5B:
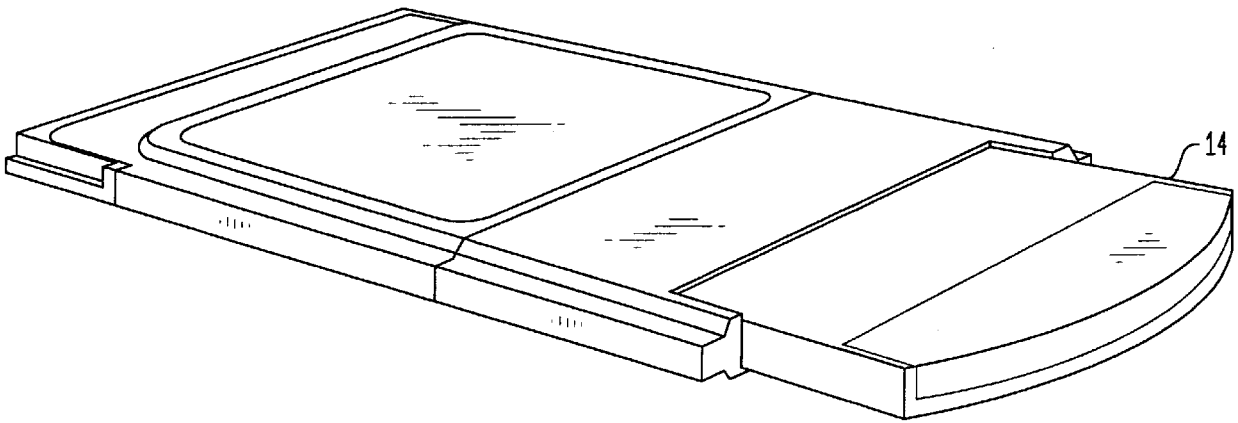

FIGS. 5A and 5B illustrate an integrated circuit card 10 according to the present invention. As shown, the integrated circuit card 10 includes a card housing 12, which houses and protects electronic components, and an antenna housing 14, which houses and protects at least one antenna. FIG. 5A shows the integrated circuit card 10 with the antenna housing 14 in the retracted state, and FIG. 5B shows the integrated circuit card 10 with the antenna housing 14 in the extended state. When the antenna housing 14 is in the retracted state as shown in FIG. 5A, the length L of the integrated circuit card 10 meets a desired standard such as PCMCIA, discussed above.

FIGS. 1A–1B, 2A–2B, 3A–3B and 4A–4B illustrates four different embodiments of the integrated circuit card 10. Each of the illustrated embodiments is a cross-section view of the integrated circuit card 10 shown in FIGS. 5A–5B. Even though each embodiment has a differently constructed antenna housing, the same reference numeral as used in FIGS. 5A–5B will be used to designate the antenna housing in each embodiment to promote ease of understanding.

Figure 1A:
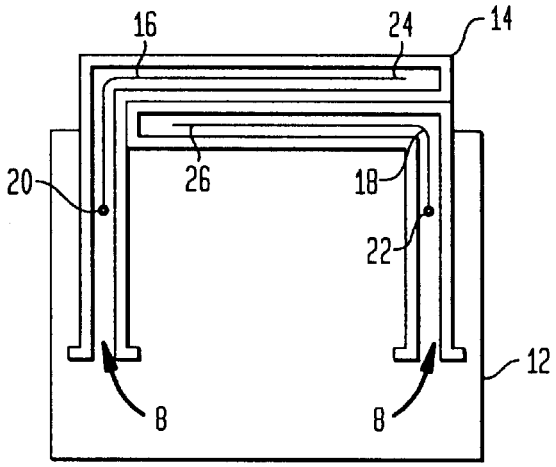
FIGS. 1A–1B, 2A–2B, 3A–3B and 4A–4B illustrate cross-sectional views of four different integrated circuit card embodiments according to the present invention.

Referring to FIG. 1A, FIG. 1A illustrates a double antenna embodiment of the present invention in the retracted state. As shown, the antenna housing 14 defines two channels 8. Each channel 8 is L-shaped and one of the channels 8 overlaps the other. A first antenna 16 has a first proximal end 20 fixed to the card housing 12, and a second antenna 18 has a second proximal end 22 fixed to the card housing 12. The first and second proximal ends 20 and 22 are electrically connected in any well-known manner to the electronic components within the card housing 12. Distal ends 24 and 26 of the first and second antennas 16 and 18, respectively, are disposed and freely slide within a respective one of the channels 8 in the antenna housing 14.

The antenna housing 14 is moveable (e.g., slides) relative to the card housing 12. As the antenna housing 14 is slid out from the card housing 12, the distal ends 24 and 26 of the first and second antennas 16 and 18 slide within their respective channels 8. In the fully extended state of FIG. 1B, flanges 28 of the antenna housing 14 abut the interior wall of the card housing 12, and prevent the antenna housing 14 from becoming separated from the card housing 12. As will be appreciated from FIG. 5B, as the antennas housing 14 is extended from the card housing 12, the first and second antennas 16 and 18 are deployed. When deployed, the first and second antennas 16 and 18 extend away from the card housing 12, thus improving their radiation characteristics. To return to the retracted state, an operator slides the antenna housing back towards the card housing 12.

Figure 1B:
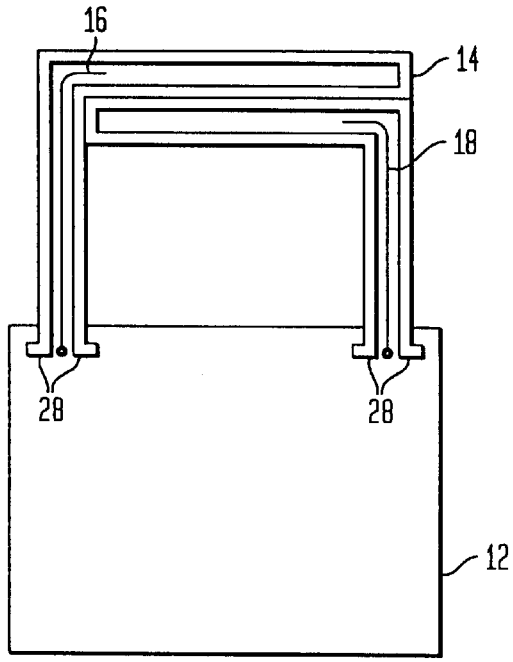
Figure 2A:
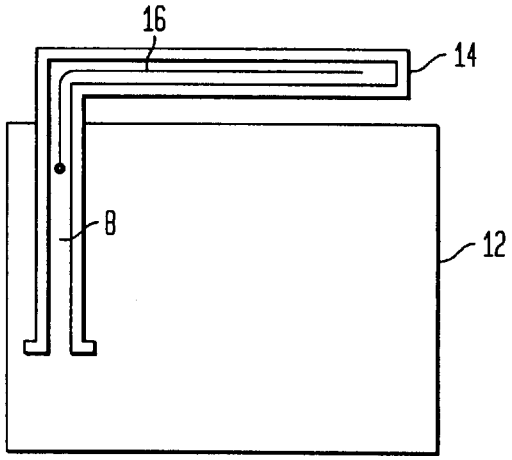
Figure 2B:
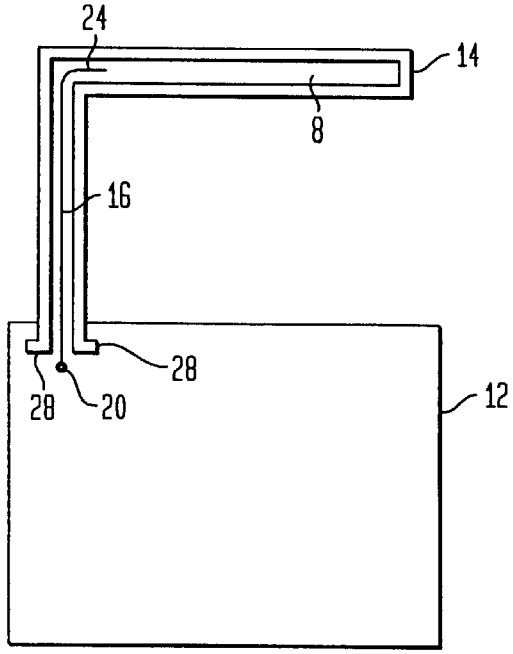

FIGS. 2A and 2B illustrate the retracted and extended states of a single antenna embodiment of the present invention that is similar to the embodiment of the FIGS. 1A and 1B. Accordingly, a redundant description of the this embodiment will not be made, and this embodiment is fully understood from the description of the embodiment of FIGS. 1A and 1B.

Figure 3A:
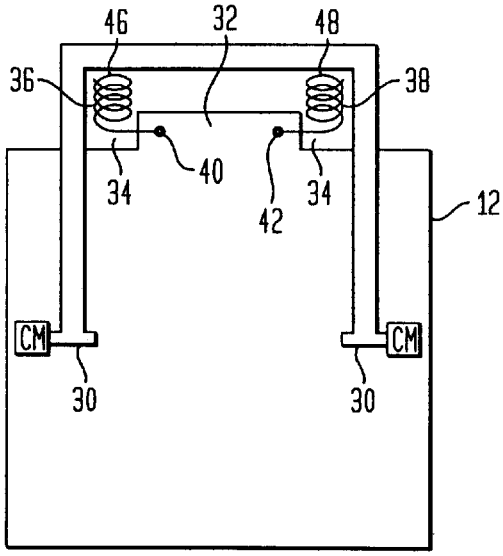
Figure 3B:
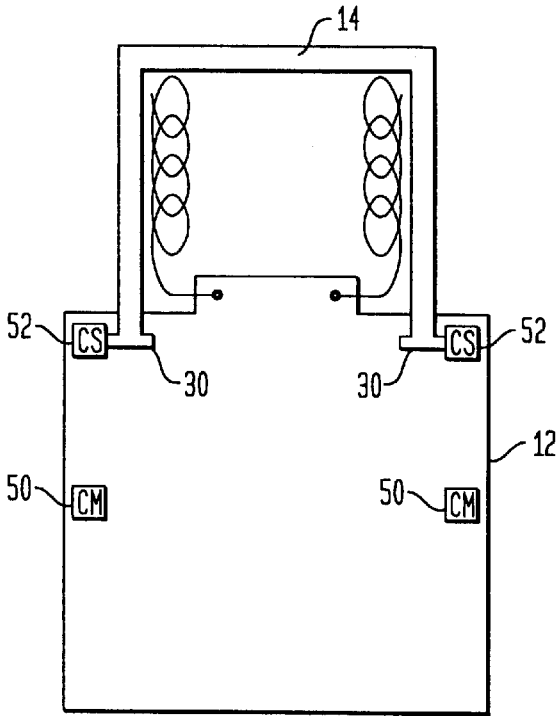

FIGS. 3A and 3B illustrate another embodiment of the present invention. As shown in FIG. 3A, the antenna housing 14 has a U-shape, with a flange 30 and a catch structure 52 at each end. The card housing 12 has a rectangular projection portion 32 that, together with the antenna housing 12, defines two gap regions 34. First and second springs 36 and 38 are respectively disposed in the two gap regions 34, and serve as first and second antennas (hereinafter referred to as first and second antennas 36 and 38). Proximal ends 40 and 42 of the first and second antennas 36 and 38 are fixed to the projecting portion 32 and are electrically connected to the electronic components housed within the card housing 12. The distal ends 46 and 48 of the first and second antennas 36 and 38 abut an interior of the antenna housing 14.

In the retracted state of FIG. 3A, the first and second antennas 36 and 38 are compressed and exert a force on the antenna housing 14 to extend the antenna housing away from the card housing 12. Two catch mechanisms 50 are disposed within the card housing 12. The catch mechanisms 50 are any well-known mechanical catch mechanisms that, together with an associated catch structure 52 at the ends of the antenna housing 14, retains the antenna housing 14 when the antenna housing 14 is moved into the retracted state. The catch mechanisms 50 and catch structures 52 also work to together to release the antenna housing 14 when the antenna housing 14 is pressed toward the card housing 12 when the antenna housing 14 is in the retracted state.

Once released, the spring force of the first and second antennas 36 and 38 fully extends the antenna housing 14 as shown in FIG. 3B. The flange 30 at each end of the antenna housing 14 prevents the antenna housing 14 from separating from the card housing 12. In the extended state, the first and second antennas 36 and 38 are deployed, thus improving their radiation characteristics. To return the antenna housing 14 to the retracted state, an operator pushes the antenna housing 14 toward the card housing 12 until the catch mechanisms 50 catch the catch structures 52.

As an alternative to the above-discussed embodiment of FIGS. 3A–3B, the distal ends 46 and 48 of the first and second antennas 36 and 38 are fixed to the antenna housing 14 in addition to or instead of fixing the proximal ends 40 and 42. As a further alternative, neither of the proximal ends 40 and 42 or the distal ends 46 and 48 are fixed. When the proximal ends 40 and 42 are not fixed, then the electrical connection of the first and second antennas 36 and 38 to the electronic components in the card housing 12 is obtained by RF coupling. Also, a single antenna embodiment can be obtained by eliminating one of the first and second antennas 36 and 38.

Figure 4A:
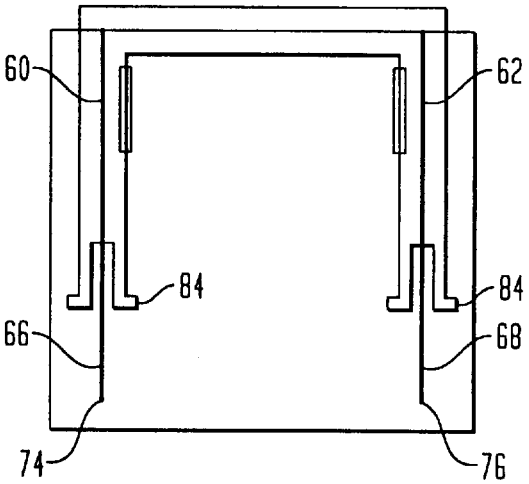
Figure 4B:
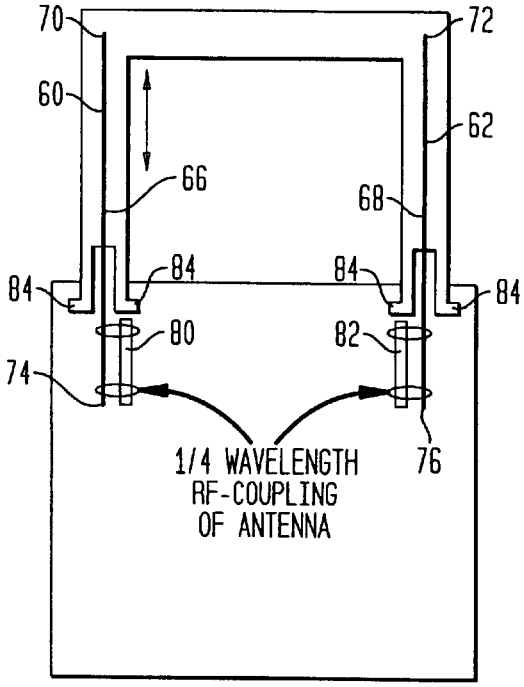

FIGS. 4A and 4B illustrate another embodiment of the present invention. FIG. 4A illustrates the antenna housing 14 in the retracted state, and FIG. 4B illustrates the antenna housing 14 in the extended state. As shown, the antenna housing 14 has a U-shape defining first and second channels 60 and 62 therein. First and second antennas 66 and 68 are disposed in the first and second channels 60 and 62. Distal ends 70 and 72 of the first and second antennas 66 and 68 are fixed to the antenna housing 14, while the proximal ends 74 and 76 of the first and second antennas 66 and 68 are free to slide within the card housing 12. The antenna housing 14 also has flanges 84 at the ends thereof. The flanges 84, as shown in FIG. 4B, prevent the antenna housing 14 from becoming separated from the card housing 12 when the antenna housing 14 is extended away from the card housing 12.

As shown in FIG. 4B, when an operator slides the antenna housing 14 away from the card housing 12, the first and second antennas 66 and 68 deploy from the card housing, thus improving their radiation characteristics. Furthermore, portions of the first and second antennas 66 and 68 extending from the antenna housing 14 and into the card housing 12 move into a position for RF coupling by quarter-wavelength RF couplers 80 and 82. In this manner, the first and second antennas 66 and 68 are electrically connected to the electronic components in the card housing 12.

As an alternative, the embodiment of FIGS. 4A and 4B is configured to have a single antenna. Also, the antenna housing 14 in both the dual and single antenna embodiments is not limited to having a U-shape.

Figure 6:
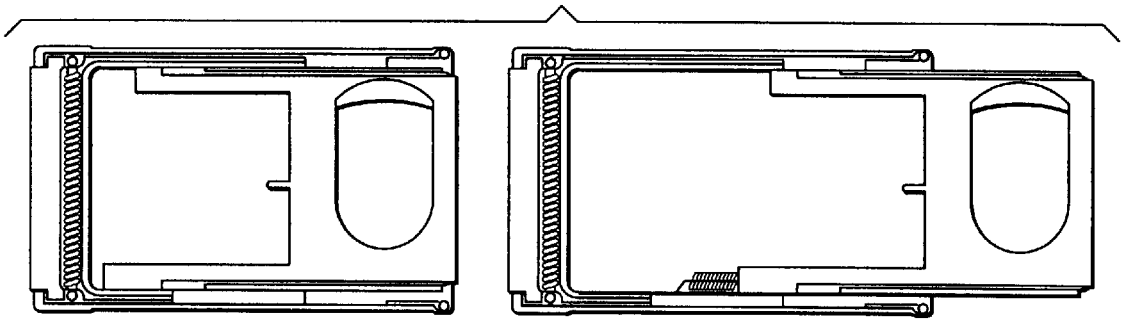
FIG. 6 (PRIOR ART)
FIGS. 6 and 7 illustrate prior art devices having pop-out components.
Figure 7:
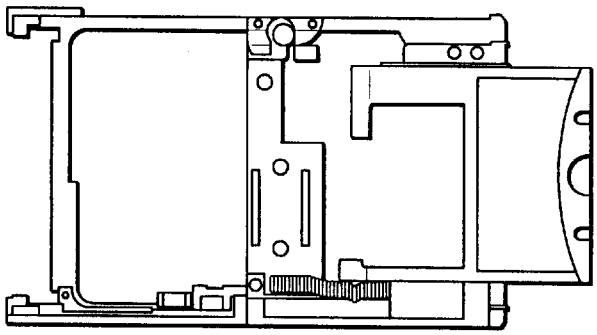
FIG. 7 (PRIOR ART)

FIGS. 6 and 7 illustrate two different types of circuit cards having pop-out components. FIG. 6 illustrates a fingerprint recognition card produced by Duel Systems. As shown, the pop-out part of this card includes the scan electronics to take a sample of a fingertip. FIG. 7 illustrates a connector for wireless Bluetooth products produced by Honda. In this device, the pop-out part includes the radio module for the device. Neither of these devices includes an antenna in the pop-out part The invention being thus described, it will be obvious that the same may be varied in many ways. Such variations are not to be regarded as a departure from the spirit and scope of the invention, and all such modifications are intended to be included within the scope of the following claims.

We claim:

1. A system for deploying an antenna of an integrated circuit card, comprising:

a card housing protecting electronic components;

an antenna housing movably connected with said card housing; and at least one antenna having a proximal end and a distal end, the distal end protected by the antenna housing, and the distal end of the antenna moving relative to the card housing in association with movement of the antenna housing.

2. The system of claim 1, wherein the proximal end is electrically connected to the electronic components.

3. The system of claim 1, wherein the proximal end is fixed relative to the card housing.

4. The system of claim 1, wherein the antenna housing includes a channel formed therein; and the distal end slides within the channel.

5. The system of claim 1, wherein the antenna is a spring, the proximal end is fixed relative to the card housing, and the proximal end abuts an interior portion of the antenna housing such that as the antenna housing is extended and retracted relative to the card housing, the spring extends and compresses.

6. The system of claim 1, wherein the antenna is a spring, the proximal end abuts the card housing and the distal end abuts an interior portion of the antenna housing such that as the antenna housing is extended and retracted relative to the card housing, the spring extends and compresses.

7. The system of claim 1, wherein the antenna is a spring, the proximal end is abuts the card housing, and the proximal end is fixed to the antenna housing such that as the antenna housing is extended and retracted relative to the card housing, the spring extends and compresses.

8. The system of claim 1, wherein the distal end is connected to the antenna housing and the proximal end moves relative to the card housing.

9. The system of claim 1, wherein the antenna housing is movable in a first direction relative to the card housing; and the proximal end of the at least one antenna does not move relative to the card housing during movement of the antenna housing in the first direction.

10. The system of claim 1, wherein the antenna housing is movable between a first position and a second position; and the at least one antenna assumes a retracted configuration when the antenna housing is in the first position and assumes an extended configuration when the antenna housing is in the second position, wherein retracted and extended configurations are different.

11. A system for deploying an antenna of an integrated circuit card, comprising:

a card housing protecting electronic components;

at least one antenna have a proximal end and a distal end;

an antenna housing protecting the antenna and movably connected to the card housing such that as the antenna housing moves relative to the card housing, the distal end of the antenna moves relative to the card housing.

12. The system of claim 11, wherein the proximal end is electrically connected to the electronic components.

13. The system of claim 11, wherein the proximal end is fixed relative to the card housing.

14. The system of claim 11, wherein the antenna housing includes a channel formed therein, and the distal end slides within the channel.

15. The system of claim 11, wherein the antenna is a spring, the proximal end is fixed relative to the card housing, and the proximal end abuts an interior portion of the antenna housing such that as the antenna housing is extended and retracted relative to the card housing, the spring extends and compresses.

16. The system of claim 11, wherein the antenna is a spring, the proximal end abuts the card housing and the distal end abuts an interior portion of the antenna housing such that as the antenna housing is extended and retracted relative to the card housing, the spring extends and compresses.

17. The system of claim 11, wherein the antenna is a spring, the proximal end is abuts the card housing, and the proximal end is fixed to the antenna housing such that as the antenna housing is extended and retracted relative to the card housing, the spring extends and compresses.

18. The system of claims 11, wherein the distal end is connected to the antenna housing and the proximal end moves relative to the card housing.

19. The system of claim 11, wherein the antenna housing is movable in a first direction relative to the card housing; and the proximal end of the at least one antenna does not move relative to the card housing during movement of the antenna housing in the first direction.

20. The system of claim 11, wherein the antenna housing is movable between a first position and a second position; and the at least one antenna assumes a retracted configuration when the antenna housing is in the first position and assumes an extended configuration when the antenna housing is in the second position, wherein retracted and extended configurations are different.

* * * * *